US006814238B2

(12) United States Patent
Lee

(10) Patent No.: US 6,814,238 B2
(45) Date of Patent: Nov. 9, 2004

(54) METHOD AND APPARATUS FOR PACKAGING PRODUCTS

(75) Inventor: Kendrew Lee, Fremont, CA (US)

(73) Assignee: Monster Cable Products, Inc., Brisbane, CA (US)

( * ) Notice: Subject to any disclaimer, the term of this patent is extended or adjusted under 35 U.S.C. 154(b) by 237 days.

(21) Appl. No.: 10/280,507

(22) Filed: Oct. 25, 2002

(65) Prior Publication Data

US 2004/0079668 A1 Apr. 29, 2004

(51) Int. Cl.[7] ..... B65D 73/00
(52) U.S. Cl. ..... 206/722; 206/471; 206/507
(58) Field of Search ..... 53/443; 206/722, 206/461, 467, 471, 505, 507

(56) References Cited

U.S. PATENT DOCUMENTS 5,875,893 A * 3/1999 Lee et al. ..... 206/463
5,890,593 A * 4/1999 Humphrey ..... 206/471
6,170,663 B1 * 1/2001 Glassman ..... 206/461

* cited by examiner

*Primary Examiner*—Jacob K. Ackun, Jr.
(74) *Attorney, Agent, or Firm*—LaRiviere, Grubman & Payne, LLP

(57) ABSTRACT

A method and an apparatus for packaging, displaying by hanging or standing, and storing of electronic products, especially of car phone chargers. The method and apparatus for packaging a product for display, such as a retail sales display, involves an anterior packaging member and a posterior packaging member, the anterior and the posterior packaging members being mounted together, such as by seam-mounting, in a fitted flange configuration. The anterior and the posterior packaging members each have a complementary contour for accommodating the product. The product may be a car phone charger, especially for a car phone charger having a retractable wire.

28 Claims, 5 Drawing Sheets

©2002 MONSTER CABLE PRODUCTS, INC.

©2002 MONSTER CABLE PRODUCTS, INC.

©2002 MONSTER CABLE PRODUCTS, INC.

©2002 MONSTER CABLE PRODUCTS, INC.

©2002 MONSTER CABLE PRODUCTS, INC.

©2002 MONSTER CABLE PRODUCTS, INC.

©2002 MONSTER CABLE PRODUCTS, INC.

©2002 MONSTER CABLE PRODUCTS, INC.

©2002 MONSTER CABLE PRODUCTS, INC.

METHOD AND APPARATUS FOR PACKAGING PRODUCTS

CROSS-REFERENCE TO RELATED APPLICATION(S)

The present application is technologically related to a concurrently filed U.S. design patent application (serial number yet to be assigned, attorney docket no. P1503).

COPYRIGHT NOTICE AND LIMITED AUTHORIZATION FOR USE

A portion of the disclosure of the present patent application contains material which is subject to copyright protection. The copyright owner has no objection to the facsimile reproduction by anyone of the patent document or the patent disclosure, as it appears in the United States Patent and Trademark Office patent file or records, but otherwise reserves all rights under the copyright laws of the United States (17 U.S.C. §106).

FIELD OF THE INVENTION

The present invention involves product packaging. More particularly, the present invention involves electronic product packaging. Even more specifically, the present invention involves car phone charger packaging for displaying and storing.

BACKGROUND OF THE INVENTION

Currently, electronic products are typically sold in a hanging plastic packaging. Thusfar, electronic product packaging, especially for car phone chargers, are configured for only hanging the product for display. As such, a long-felt need is seen to exist for a packaging method and apparatus for conveniently packaging, displaying by both hanging or standing, and storing of electronic products, especially of car phone chargers.

BRIEF SUMMARY OF THE INVENTION

Accordingly, the present invention addresses this long-felt need for a packaging method and apparatus for conveniently packaging, displaying by both hanging or standing, and storing of electronic products, especially of car phone chargers. Generally, the present method and apparatus for packaging a product for display, such as a retail sales display, involves an anterior packaging member and a posterior packaging member, the anterior and the posterior packaging members being mounted together.

The anterior and the posterior packaging members may each have a complementary contour for retaining the product. The product may be a car phone charger, especially a car phone charger having a retractable wire. The anterior and posterior packaging members' respective complementary contours may have a molded protrusion for accommodating a body portion of the car phone charger, a molded protrusion for accommodating a terminal portion of the car phone charger, a molded channel for accommodating a wire portion (especially a retractable wire portion of the charger), and a molded protrusion for accommodating any slack of the wire portion.

The anterior and the posterior packaging members may each be formed from a material having an optical property such as transparency, translucency, and opacity. The anterior and the posterior packaging members may each also have an advertising member, such as at least one insert. The posterior packaging member's at least one insert may have at least one slit for conforming to, and partially lining, the wire portion slack molded protrusion, thereby allowing the consumer to view the interior of the wire portion slack molded protrusion and to inspect its contents. The posterior packaging member may have a floor member for alternatively facilitating standing of the apparatus on a horizontal surface for display. The anterior packaging member and the posterior packaging member may each have at least one coincident orifice for facilitating displaying the at least one product by hanging as well. The retractable wire may be threaded from the charger body portion, through the at least one insert, and through the channel, and into the corresponding molded protrusion.

Advantages of the present invention include, but are not limited to, conveniently packaging, displaying by both hanging and standing, and storing of electronic products, especially of car phone chargers having a retractable wire. In addition, each package may be nested or complementary-fitted on any other such package. Other features of the present invention are disclosed, or are apparent in the section entitled "Detailed Description of the Invention."

BRIEF DESCRIPTION OF THE DRAWING

For a better understanding of the present invention, reference is made to the below-referenced accompanying Drawing. Reference numbers refer to the same or equivalent parts of the present invention throughout the several figures of the Drawing.

(1)

(2)

(3)

(4)

(5)

(6)

(7)

(8)

(9)

DETAILED DESCRIPTION OF THE INVENTION

Figure 1:
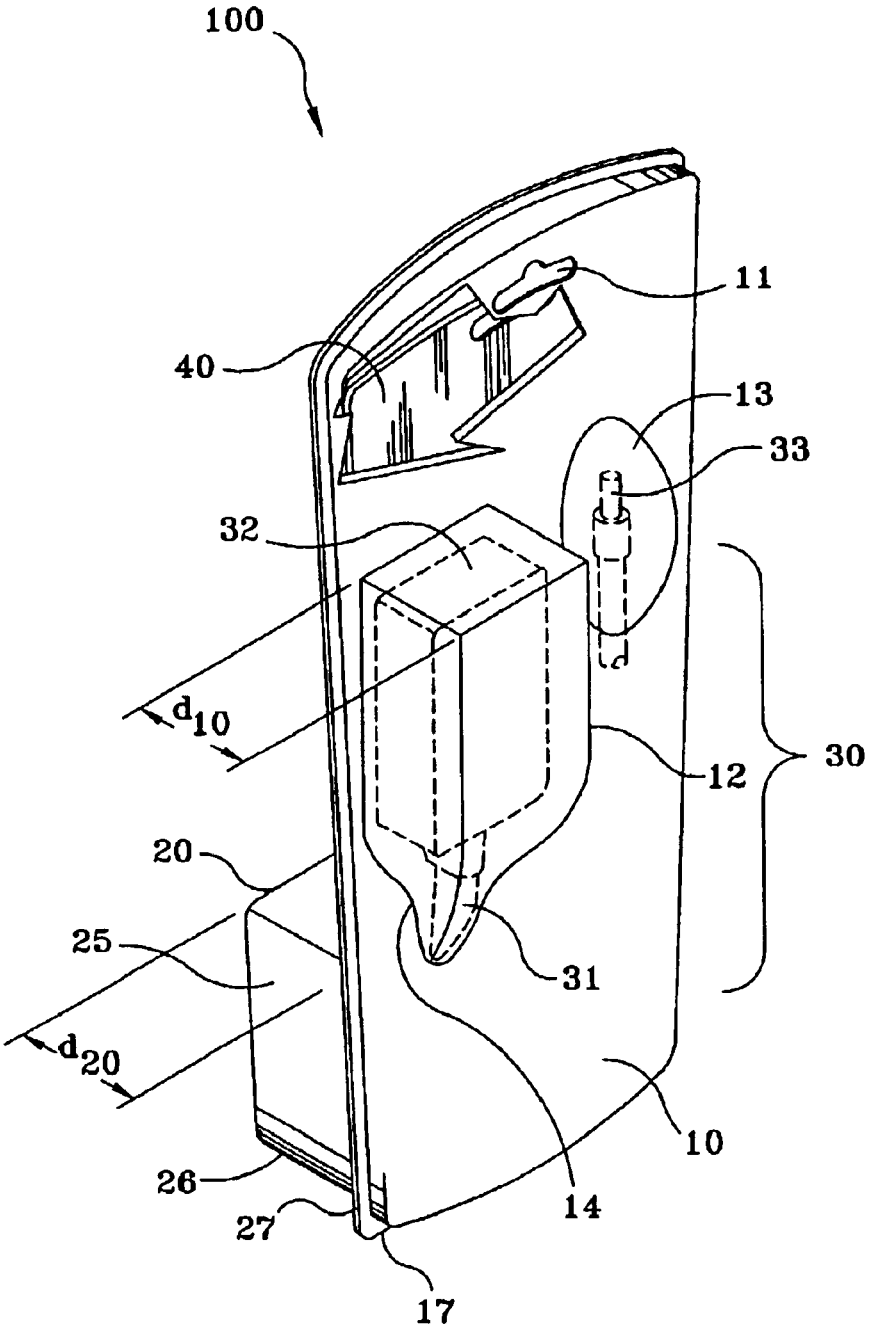
FIG. 1 is a perspective view of the apparatus, in an assembled state, for packaging, displaying, and storing of electronic products, especially of car phone chargers, in accordance with the present invention.

FIG. 1 illustrates, in a perspective view, the apparatus 100 for packaging, displaying, and storing of electronic products, especially of car phone chargers, in accordance with the present invention. The apparatus 100 comprises an anterior packaging member 10 and a posterior packaging member 20, wherein the anterior and the posterior packaging members 10, 20 are mounted together in a fitted flange configuration 17, 27 by at least one technique such as seam-mounting, adhesion, interference-fit, compression-fit, tongue and groove, clip, staple, and tape. The anterior and the posterior packaging members 10, 20 may each have a complementary contour for accommodating the product. The product may be a car phone charger 30, especially a car phone charger 30 having a retractable wire. The anterior and posterior packaging members' respective complementary contours may have a respective molded protrusion 12,22 (e.g., having a conforming shape) for accommodating a body portion 32 of the car phone charger 30, wherein protrusion 22 is optional and, therefore, is not shown in the figure, a molded protrusion 13, 23 (e.g., having a shape such as a semi-ellipsoid of revolution) for accommodating a terminal portion 33 of the car phone charger 30, wherein the protrusion 23 is disposed behind the protrusion 13 and, therefore, is not shown in this figure, a molded channel 14, 24 (e.g., having a cylindrical shape) for accommodating a wire portion 31 (especially a retractable wire portion of the charger), wherein the channel 24 is disposed behind the channel 14 and, therefore, is not shown in this figure, and a molded protrusion 15, 25 (e.g., having a rectanguloid shape) for accommodating any slack of the wire portion 31, wherein protrusion 15 is optional and, therefore, is not shown in the figure. The anterior and the posterior packaging members 10, 20 may each be formed from a material having an optical property such as transparency, translucency, and opacity. The anterior and the posterior packaging members 10, 20 may each also have an advertising member, such as at least one insert 40. The posterior packaging member's at least one insert 40 may have at least one slit 41 (not shown) for conforming to, partially lining, the wire portion slack molded protrusion 25, thereby allowing the consumer to view an interior volume of the wire portion slack molded protrusion 25 and its contents. The posterior packaging member 20 may have a floor member 26 for alternatively facilitating displaying of the product by standing of the apparatus 100 on a horizontal surface $S_h$ (not shown). The anterior and the posterior packaging members 10, 20 may each have at least one respective coincident orifice 11, 21 for facilitating displaying the product by hanging on a vertical surface $S_v$ as well (surface $S_v$ and orifice 21 are not shown). The anterior packaging member 10 and the posterior packaging member 20 each comprise an interior contour for accommodating and retaining the product and an exterior contour for a complementary-fit of the apparatus to any such other apparatus. In addition, the anterior packaging member exterior body contour portion may comprise a projection, wherein the posterior packaging member exterior wire contour portion comprises an exterior channel portion and an exterior slack portion. Likewise, the posterior packaging member exterior wire contour portion exterior slack portion may comprises a projection, wherein the anterior packaging member exterior body contour portion projection $d_{10}$ approximates the posterior packaging member exterior wire contour portion exterior slack portion projection $d_{20}$ for facilitating the complementary-fit of the apparatus 100 to any other such apparatus 100.

Figure 2:
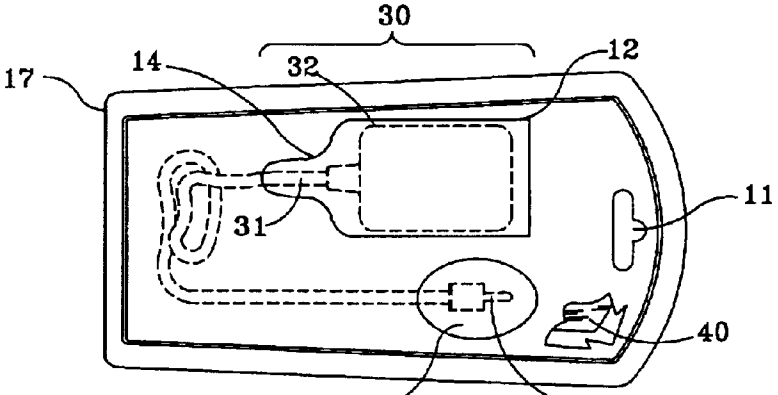
FIG. 2 is an anterior view of the apparatus of FIG. 1, illustrating the disposition of the product being packaged, in accordance with the present invention.

FIG. 2 illustrates, in an anterior view, the apparatus 100 of FIG. 1, and the disposition of the product being packaged, in accordance with the present invention. The anterior packaging member 10 may have a complementary contour for accommodating the product. The anterior packaging member complementary contour may have a molded protrusion 12 (e.g., having a conforming shape) for accommodating a body portion 32 of the car phone charger 30, a molded protrusion 13 (e.g., having a shape such as a semi-ellipsoid of revolution) for accommodating a terminal portion 33 of the car phone charger 30, a molded channel 14 (e.g., having a cylindrical shape) for accommodating a wire portion 31 (especially a retractable wire portion of the charger), and a molded protrusion 15 (e.g., having a rectanguloid shape) for accommodating any slack of the wire portion 31, wherein protrusion 15 is optional and, therefore, is not shown in the figure. The retractable wire may be threaded from the charger body portion 32, through the at least one insert 40, and through the channel 14 (not shown), wherein the terminal portion 33 is disposed and confined within the anterior packaging member's molded protrusion 13 and the corresponding posterior packaging member's molded protrusion 23 (See also FIG. 3.).

Figure 3:
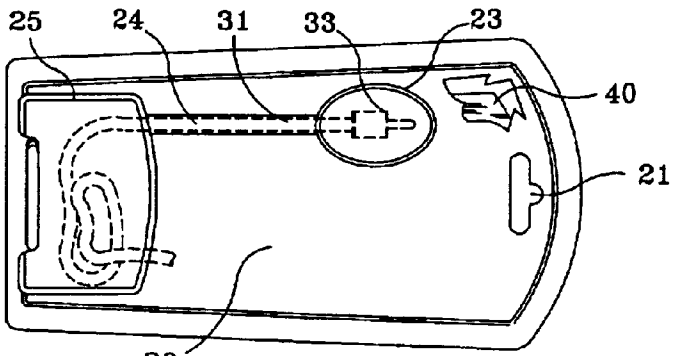
FIG. 3 is a posterior view of the apparatus of FIG. 1, illustrating the disposition of the product being packaged, in accordance with the present invention.

FIG. 3 illustrates, in a posterior view, the apparatus 100 of FIG. 1, and the disposition of the product being packaged, in accordance with the present invention. The posterior packaging member 20 may have a complementary contour for accommodating the product. The posterior packaging member complementary contour may have a molded protrusion 22 (e.g., having a conforming shape) for accommodating a body portion 32 of the car phone charger 30, wherein protrusion 22 is optional and, therefore, is not shown in the figure, a molded protrusion 23 (e.g., having a shape such as a semi-ellipsoid of revolution or an elliptical cylinder) for accommodating a terminal portion 33 of the car phone charger 30, a molded channel 24 (e.g., having a cylindrical shape) for accommodating a wire portion 31 (especially a retractable wire portion of the charger), and a molded protrusion 25 (e.g., having a rectanguloid shape) for accommodating any slack of the wire portion 31. The retractable wire may be threaded from the charger body portion 32, through the at least one insert 40, and through the channel 24, wherein the terminal portion 33 is disposed and confined within the anterior packaging member's molded protrusion 13 and the corresponding posterior packaging member's molded protrusion 23.

Figure 4:
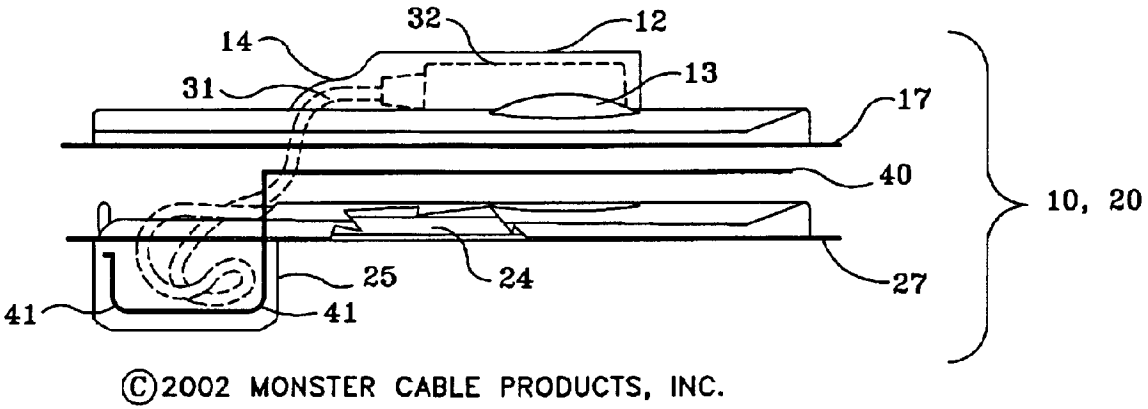
FIG. 4 is a lateral view of the apparatus of FIG. 1, illustrating the disposition of the product being packaged, in accordance with the present invention.

FIG. 4 illustrates, in a lateral view, the apparatus 100 of FIG. 1, and the disposition of the product being packaged, in accordance with the present invention. The posterior packaging member's at least one insert 40 may have at least one slit 41 for facilitating the at least one insert's bending to conform and partially line the wire portion slack molded protrusion 25, thereby allowing the consumer to view an interior volume of the wire portion slack molded protrusion 25 and its content.

Figure 5:
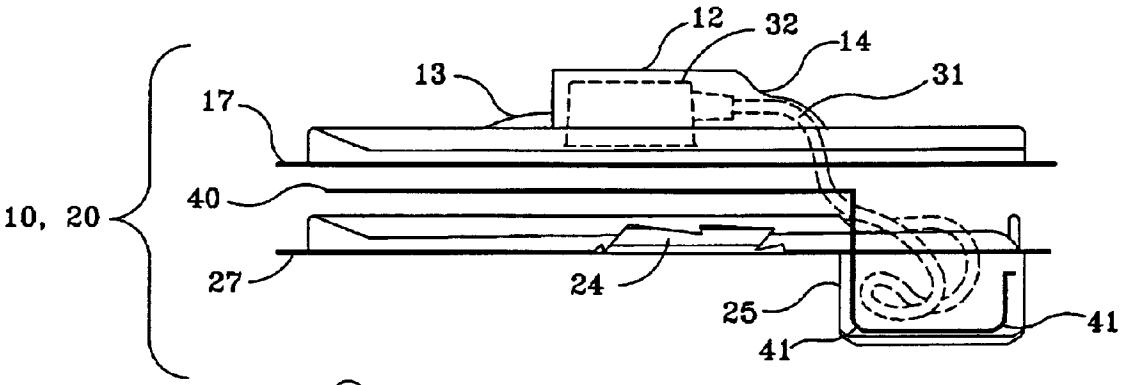
FIG. 5 is an opposing lateral view of the apparatus of FIG. 1, illustrating the disposition of the product being packaged, in accordance with the present invention.

FIG. 5 illustrates, in an opposing lateral view, the apparatus 100 of FIG. 1, and the disposition of the product being packaged, in accordance with the present invention. The posterior packaging member's at least one insert 40 may have at least one slit 41 for facilitating the at least one insert's bending to conform and partially line the wire portion slack molded protrusion 25, thereby allowing the consumer to view an interior volume of the wire portion slack molded protrusion 25 and its content.

Figure 6:
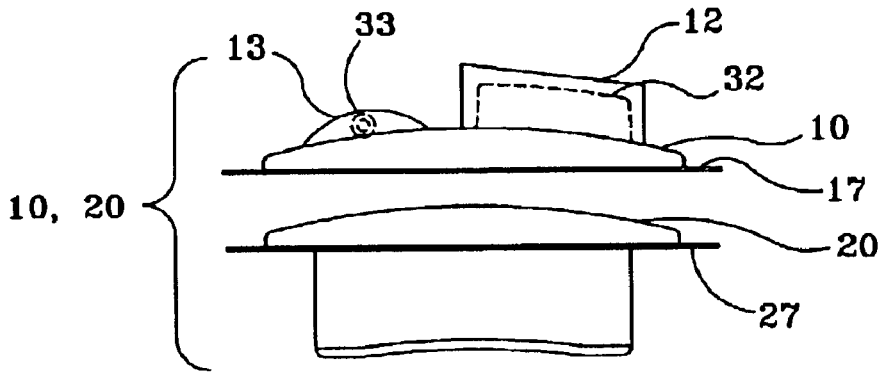
FIG. 6 is a top view of the apparatus of FIG. 1, illustrating the disposition of the product being packaged, in accordance with the present invention.

FIG. 6 illustrates, in a top view, the apparatus 100 of FIG. 1, and the disposition of the product being packaged, in accordance with the present invention. The anterior and the posterior packaging members 10, 20 are mounted together in a fitted flange configuration 17, 27, for instance.

Figure 7:
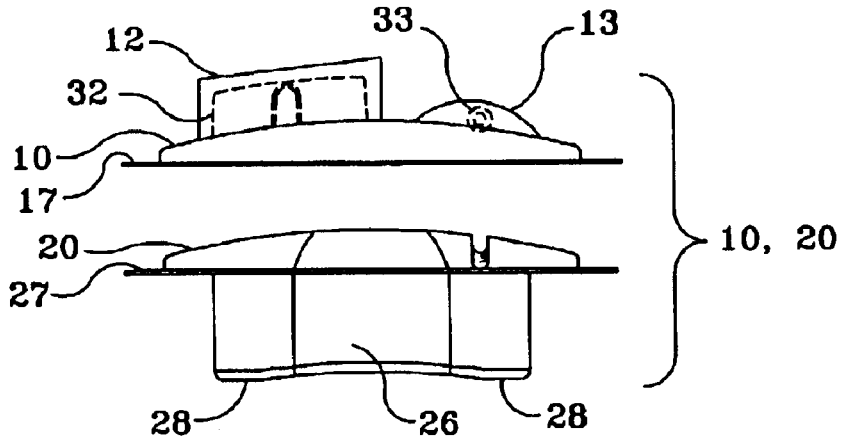
FIG. 7 is a bottom view of the apparatus of FIG. 1, illustrating the disposition of the product being packaged, in accordance with the present invention.

FIG. 7 is a bottom view of the apparatus of FIG. 1, illustrating the disposition of the product being packaged, in accordance with the present invention. The anterior and the posterior packaging members 10, 20 are mounted together in a fitted flange configuration 17, 27, for instance. The posterior packaging member 20 may have a floor member 26 for alternatively facilitating displaying of the product by standing of the apparatus 100 on a horizontal surface $S_h$ (not shown). The floor member 26 may also have at least one foot member 28 for facilitating stable display of the product on the horizontal surface $S_h$ (not shown).

Figure 8:
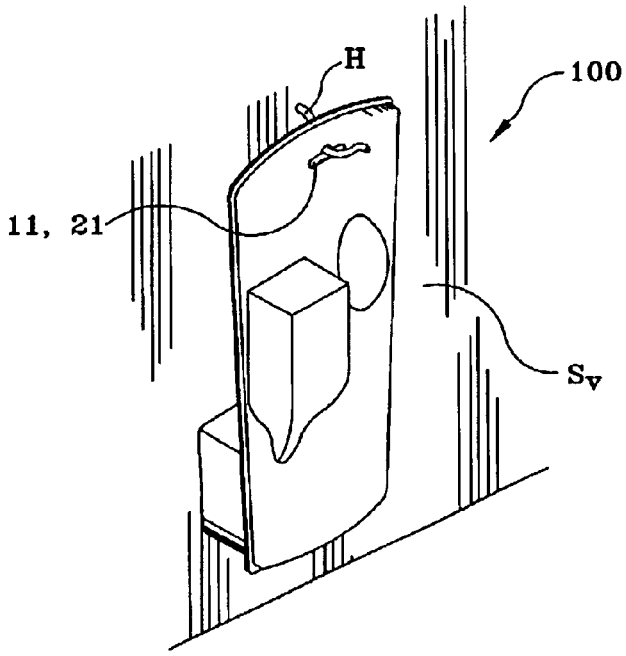
FIG. 8 is a perspective view of the apparatus of FIG. 1, in an assembled state, illustrating its disposition as being hung on a vertical surface, such as a display wall, in accordance with the present invention.

FIG. 8 is a perspective view of the apparatus 100 of FIG. 1, in an assembled state, illustrating its disposition as being hung on a vertical surface $S_v$, such as a display wall, using means for hanging H, such as a hook, through the at least one coincident orifice 11, 21, in accordance with the present invention. The apparatus 100 is, thus, useful to both the retailer and the consumer in that the packaged product may be stored on any vertical surface $S_v$ as the product is maintained in the apparatus 100 by the anterior and posterior packaging members 10, 20 being mounted together.

Figure 9:
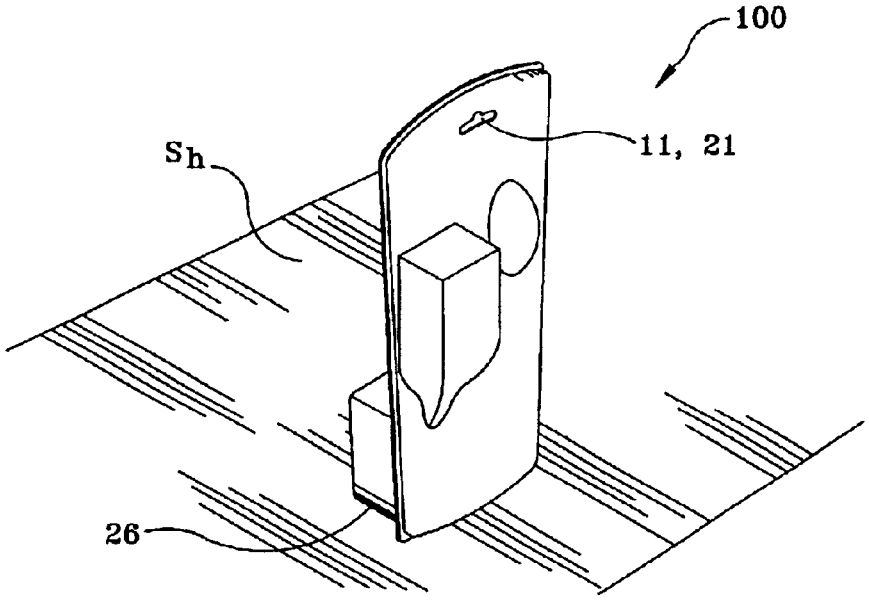
FIG. 9 is a perspective view of the apparatus of FIG. 1, in an assembled state, illustrating its disposition as being stood on a horizontal surface, such as a display table, in accordance with the present invention.

FIG. 9 is a perspective view of the apparatus 100 of FIG. 1, in an assembled state, illustrating its disposition as being stood on a horizontal surface $S_h$, such as a display table or a consumer workbench, in accordance with the present invention. The apparatus 100 is, thus, useful to both the retailer and the consumer in that the packaged product may be stored on any horizontal surface $S_h$ as the product is maintained in the apparatus 100 by the floor member 26, which facilitates standing of the apparatus 100 on the horizontal surface $S_h$. The floor member 26 may also be disposed at an angle θ in a range of 0 degrees to 90 degrees (0°–90°) for facilitating stable display of the product on the horizontal surface $S_h$. Preferably, the angle θ is in a range of 45 degrees to 90 degrees (45°–90°) for providing greater visual access to the consumer.

While the particular method and apparatus, as herein shown and described in detail, are fully capable of attaining the above-described advantages of the invention, the presently preferred embodiment of the present invention is understood to be merely representative of the subject matter which is broadly contemplated by the present invention, the scope of the present invention fully encompasses other embodiments which may become obvious to those skilled in the art, and that the scope of the present invention is accordingly to be limited by nothing other than the appended claims, in which reference to an element in the singular is not intended to mean "one and only one" unless explicitly so stated, but rather "one or more." All structural and functional equivalents to the elements of the above-described preferred embodiment that are known to those of ordinary skill in the art are expressly incorporated herein by reference and are intended to be encompassed by the present claims.

Moreover, no requirement exists for a device or method to address each and every problem sought to be resolved by the present invention, for such to be encompassed by the present claims. Furthermore, no element, component, or method step in the present disclosure is intended to be dedicated to the public regardless of whether the element, component, or method step is explicitly recited in the claims. However, it should be readily apparent to those of ordinary skill in the art that various changes and modifications in form, semiconductor material, and fabrication material detail may be made without departing from the spirit and scope of the inventions as set forth in the appended claims. No claim herein is to be construed under the provisions of 35 U.S.C. §112, sixth paragraph, unless the element is expressly recited using the phrase "means for."

What is claimed:

1. An apparatus for packaging, displaying, and storing an electronic product, comprising:

an anterior packaging member having an exterior;

a posterior packaging member having an exterior; and at least one insert for advertising;

the anterior and the posterior packaging members being mounted together, the electronic product and the at least one insert being disposed within the anterior and the posterior packaging members so mounted, the posterior packaging member comprising a floor member for facilitating standing of the apparatus on a horizontal surface, and the anterior packaging member and the posterior packaging member each comprising:

an interior contour for accommodating and retaining the product; and an exterior contour for a complementary-fit of the apparatus to any such other apparatus.

2. An apparatus, as recited in claim 1, wherein the electronic product comprises a car phone charger comprising:

a body;

a wire; and a terminal, wherein the anterior and the posterior packaging member interior contours each comprises at least one contour portion selected from a group consisting essentially of an interior body contour portion, an interior wire contour portion, and an interior terminal contour portion, and wherein the anterior and the posterior packaging member exterior contours each comprises at least one contour portion selected from a group consisting essentially of an exterior body contour portion, an exterior wire contour portion, and an exterior terminal contour portion.

3. An apparatus, as recited in claim 2, wherein the interior and the exterior body contour portions each comprises at least one configuration selected from a group consisting essentially of a semi-spheroid and a semi-cylinder, wherein the interior and the exterior wire contour portions each comprises at least one configuration selected from a group consisting essentially of a semi-cylinder and a rectangluoid, and wherein the interior and the exterior terminal contour portions each comprises at least one configuration selected from a group consisting essentially of a semi-ellipsoid and an elliptic cylinder.

4. An apparatus, as recited in claim 1, further comprising means for mounting together the anterior packaging member and the posterior packaging member.

5. An apparatus, as recited in claim 4, wherein the mounting means comprises:

at least one mating flange formed in the anterior packaging member; and at least one mating flange formed in the posterior packaging member, wherein the at least one anterior and the at least one posterior packaging member mating flanges are mounted together.

6. An apparatus, as recited in claim 4, wherein the mounting means comprises at least one technique selected from a group consisting essentially of seam-mount, adhesion, interference-fit, compression-fit, tongue and groove, clip, staple, and tape.

7. An apparatus, as recited in claim 1, wherein the anterior and the posterior packaging members each comprises at least one coincident orifice for facilitating displaying the at least one product by hanging.

8. An apparatus, as recited in claim 1, wherein the anterior and the posterior packaging members each comprises a material having an optical property selected from a group consisting essentially of transparency, translucency, and opacity.

9. An apparatus, as recited in claim 1, wherein the at least one insert comprises at least one slit for facilitating conforming the at least one insert to the interior contour.

10. An apparatus, as recited in claim 1, wherein the floor member is disposed at an angle in a range of 0 degrees to 90 degrees (0°–90°) with respect to the anterior and the posterior packaging members for facilitating stable display of the product on a horizontal surface.

11. An apparatus, as recited in claim 1, wherein the floor member is disposed at an angle in a range of 45 degrees to 90 degrees (45°–90°) with respect to the anterior and the posterior packaging members for facilitating stable display of the product on a horizontal surface.

12. An apparatus, as recited in claim 1, wherein the floor member comprises at least one foot member for further facilitating stable display of the product on a horizontal surface.

13. An apparatus, as recited in claim 2, wherein the anterior packaging member exterior body contour portion comprises a projection, wherein the posterior packaging member exterior wire contour portion comprises:

an exterior channel portion; and an exterior slack portion, wherein the posterior packaging member exterior wire contour portion exterior slack portion comprises a projection, and wherein the anterior packaging member exterior body contour portion projection approximates the posterior packaging member exterior wire contour portion exterior slack portion projection for facilitating the complementary-fit of the apparatus to any other such apparatus.

14. An apparatus for packaging, displaying, and storing of an electronic product, comprising:

an anterior packaging member having an exterior;

a posterior packaging member having an exterior;

at least one insert for advertising; and means for mounting together the anterior packaging member and the posterior packaging member, the anterior and the posterior packaging members being mounted together, the electronic product and the at least one insert being disposed within the anterior and the posterior packaging members so mounted, the posterior packaging member comprising a floor member for facilitating standing of the apparatus on a horizontal surface, and the anterior packaging member and the posterior packaging member each comprising:

an interior contour for accommodating and retaining the product; and an exterior contour for a complementary-fit of the apparatus to any other such apparatus, wherein the electronic product comprises a car phone charger comprising:

a body;

a wire; and a terminal, wherein the anterior and the posterior packaging member interior contours each comprises at least one contour portion selected from a group consisting essentially of an interior body contour portion, an interior wire contour portion, and an interior terminal contour portion, and wherein the anterior and the posterior packaging member exterior contours each comprises at least one contour portion selected from a group consisting essentially of an exterior body contour portion, an exterior wire contour portion, and an exterior terminal contour portion.

15. An apparatus, as recited in claim 14, wherein the interior and the exterior body contour portions each comprises at least one configuration selected from a group consisting essentially of a semi-spheroid and a semi-cylinder, wherein the interior and the exterior wire contour portions each comprises at least one configuration selected from a group consisting essentially of a semi-cylinder and a rectangluoid, wherein the interior and the exterior terminal contour portions each comprises at least one configuration selected from a group consisting essentially of a semi-ellipsoid and an elliptic cylinder, wherein the mounting means comprises:

at least one mating flange formed in the anterior packaging member; and at least one mating flange formed in the posterior packaging member, wherein the at least one anterior and the at least one posterior packaging member mating flanges are mounted together, wherein the mounting means comprises at least one technique selected from a group consisting essentially of seam-mount, adhesion, interference-fit, compression-fit, tongue and groove, clip, staple, and tape, wherein the anterior and the posterior packaging members each comprises at least one coincident orifice for facilitating displaying the at least one product by hanging, wherein the anterior packaging member and the posterior packaging member each comprise a material having an optical property selected from a group consisting essentially of transparency, translucency, and opacity, wherein the at least one insert comprises at least one slit for facilitating conforming the at least one insert to the interior contour, wherein the floor member is disposed at an angle in a range of 90 degrees or less (≦90) for facilitating stable display of the product on a horizontal surface, and wherein the floor member comprises at least one foot member for further facilitating stable display of the product on a horizontal surface, wherein the anterior packaging member exterior body contour portion comprises a projection, wherein the posterior packaging member exterior wire contour portion comprises:

a exterior channel portion and an exterior slack portion, wherein the posterior packaging member exterior wire contour portion exterior slack portion comprises a projection, and wherein the anterior packaging member exterior body contour portion projection approximates the posterior packaging member exterior wire contour portion exterior slack portion projection for facilitating the complementary-fit of the apparatus to any other such apparatus.

16. A method for packaging, displaying, and storing an electronic product, comprising:

providing an anterior packaging member having an exterior;

providing a posterior packaging member having an exterior;

providing an electronic product;

providing at least one insert for advertising; and mounting the anterior and the posterior packaging members together, the electronic product and the at least one insert being disposed within the anterior and the posterior packaging members so mounted, the posterior packaging member comprising a floor member for facilitating standing of the apparatus on a horizontal surface, and the anterior packaging member and the posterior packaging member each comprising:

an interior contour for accommodating and retaining the product; and an exterior contour for a complementary-fit of the apparatus to any other such apparatus.

17. A method, as recited in claim 16, wherein the electronic product providing step comprises providing a car phone charger comprising:

a body;

a wire; and a terminal, wherein the anterior and the posterior packaging member providing steps respectively comprise providing the anterior and the posterior packaging member interior contours each with at least one contour portion selected from a group consisting essentially of an interior body contour portion, an interior wire contour portion, and an interior terminal contour portion, and wherein the anterior and the posterior packaging member providing steps respectively comprise providing the anterior and the posterior packaging member exterior contours each with at least one contour portion selected from a group consisting essentially of an exterior body contour portion, an exterior wire contour portion, and an exterior terminal contour portion.

18. A method, as recited in claim 17, wherein the anterior and the posterior packaging member providing steps respectively comprise providing the interior and the exterior body contour portions each with at least one configuration selected from a group consisting essentially of a semi-spheroid and a semi-cylinder, wherein the anterior and the posterior packaging member providing steps respectively comprise providing the interior and the exterior wire contour portions each with at least one configuration selected from a group consisting essentially of a semi-cylinder and a rectangluoid, and wherein the anterior and the posterior packaging member providing steps respectively comprise providing the interior and the exterior terminal contour portions each with at least one configuration selected from a group consisting essentially of a semi-ellipsoid and an elliptic cylinder.

19. A method, as recited in claim 16, wherein the mounting step comprises using means for mounting together the anterior packaging member and the posterior packaging member.

20. A method, as recited in claim 19, wherein using the mounting means comprises:

forming at least one mating flange in the anterior packaging member; and forming at least one mating flange in the posterior packaging member, wherein the at least one anterior and the at least one posterior packaging member mating flanges are mounted together.

21. A method, as recited in claim 19, wherein using the mounting means comprises at least one technique selected from a group consisting essentially of seam-mount, adhesion, interference-fit, compression-fit, tongue and groove, clip, staple, and tape.

22. A method, as recited in claim 16, wherein the anterior and the posterior packaging member providing steps respectively comprise providing the anterior and the posterior packaging members each with at least one coincident orifice for facilitating displaying the at least one product by hanging.

23. A method, as recited in claim 16, wherein the anterior and the posterior packaging member providing steps respectively comprise providing the anterior and the posterior packaging members each with a material having an optical property selected from a group consisting essentially of transparency, translucency, and opacity.

24. A method, as recited in claim 16, wherein the at least one insert providing step comprises providing at least one slit for facilitating conforming the at least one insert to the interior contour.

25. A method, as recited in claim 16, wherein the posterior packaging member providing step comprises providing the floor member being disposed at an angle in a range of 0 degrees to 90 degrees (0°–90°) with respect to the anterior and the posterior packaging members for facilitating stable display of the product on a horizontal surface.

26. A method, as recited in claim 16, wherein the posterior packaging member providing step comprises providing the floor member being disposed at an angle in a range of 45 degrees to 90 degrees (45°–90°) with respect to the anterior and the posterior packaging members for facilitating stable display of the product on a horizontal surface.

27. A method, as recited in claim 16, wherein the posterior packaging member providing step comprises providing the floor member with at least one foot member for further facilitating stable display of the product on a horizontal surface.

28. A method, as recited in claim 17, wherein the anterior packaging member providing step comprises providing the anterior packaging member exterior body contour portion with a projection, wherein the posterior packaging member providing step comprises providing the posterior packaging member exterior wire contour portion with an exterior channel portion and an exterior slack portion, wherein the posterior packaging member providing step comprises providing the posterior packaging member exterior wire contour portion exterior slack portion with a projection, and wherein the anterior packaging member providing step and the posterior packaging member providing step together comprise approximating the anterior packaging member exterior body contour portion projection to the posterior packaging member exterior wire contour portion exterior slack portion projection for facilitating the complementary-fit of the apparatus to any other such apparatus.

* * * * *